United States Patent [19]

Thurston et al.

[11] 4,111,513

[45] Sep. 5, 1978

[54] CABLE-CONNECTOR BACKSHELL ADAPTER DEVICE

[75] Inventors: Bruce E. Thurston, Parlin; Albert H. Owens, Sparta; Powell J. Pocsi, Warren, all of N.J.

[73] Assignee: The United States of America as represented by the Secretary of the Army, Washington, D.C.

[21] Appl. No.: 835,548

[22] Filed: Sep. 22, 1977

[51] Int. Cl.[2] ..... H01R 3/06; H01R 13/46

[52] U.S. Cl. ..... 339/143 R; 339/275 R

[58] Field of Search ..... 339/143 R, 275 R

[56] References Cited

U.S. PATENT DOCUMENTS

| | | | |
|---|---|---|---|
| 3,099,506 | 7/1963 | Tuchel | 339/143 R |
| 3,659,251 | 4/1972 | Fish | 339/143 R |
| 3,944,317 | 3/1976 | Oberdiear | 339/143 R |
| 4,018,979 | 4/1977 | Young | 339/143 R X |

*Primary Examiner*—Roy Lake
*Assistant Examiner*—E. F. Desmond
*Attorney, Agent, or Firm*—Nathan Edelberg; A. Victor Erkkila; Max Yarmovsky

[57] ABSTRACT

A cable-connector adapter backshell device is used to provide increased reliability of soldered connections from an externally shielded cable having a plurality of internally shielded electrical conductors which are required to make positive electrical connections with the terminals of a multi-terminal plug connector. A split pair of interlocking adapters are utilized to reduce the number of piece parts to completely shield the interface connections between the shielded cable and the plug connector, to reduce the number of solder joints, and to enable all conductor-terminal solder joints to be visible and inspectable after soldering.

5 Claims, 6 Drawing Figures

CABLE-CONNECTOR BACKSHELL ADAPTER DEVICE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to provide an effective interface adapter between a multi-stranded shielded electrical cable and the terminals of a plug connector. One of the problems encountered with prior art backshell designs is the large number of pieces which must be assembled and soldered together to effect a secure shielded connection. Another problem with prior art designs is that the cable electro-magnetic shield is generally soldered to the inside pieces of the backshell, making the connections uninspectable after soldering the outside pieces of the backshell. Other prior art backshell designs which are not soldered, are frequently complex to design, difficult to assemble, costly to manufacture, and do not offer the same reliability as soldered backshells.

SUMMARY OF THE INVENTION

The present invention relates to a shielded cable-connector backshell device comprising a pair of split interlocking adapters which permits all soldered joints from the cable to the terminals of a plug connector to be visibly inspected after soldering. A grooved flanged base adapter section is first threadedly attached and then pinned to the plug connector. A cover adapter section is designed to slidably fit over and interlock with the base section providing a mechanical support for the cable assembly, and a solder area for the external cable shield. The adapter cover and adapter base are soldered together after the internal conductor braid shields are fixedly soldered in the base grooves.

An object of the present invention is to provide a cable-connector adapter backshell which has only two sections thereto and insures speed of assembly.

Another object of the present invention is to provide a cable-connector adapter backshell device which permits visual inspection of all conductor to plug terminal soldered joints.

Another object of the present invention is to provide a cable-connector adapter backshell device which has increased reliability because the number of solder joints is reduced.

A further object of the present invention is to provide a cable-connector adapter backshell of substantially lower cost than prior art devices, because of the simplicity of design and reduced number of members making up the assembly.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 3:
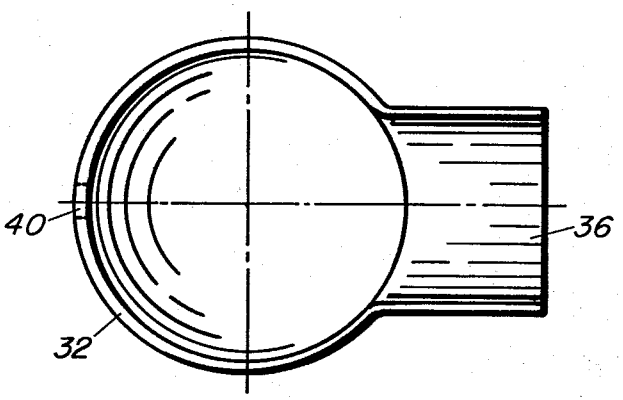
FIG. 3 is a view of the cover backshell adapter taken along line 3—3 of FIG. 1.
Figure 4:
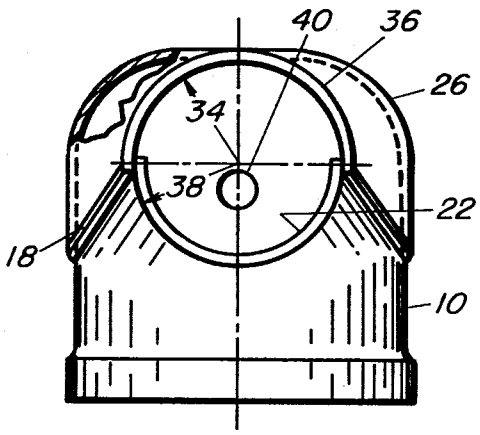
FIG. 4 is an end view of the cover and base members taken along line 4—4 of FIG. 1.
Figure 2:
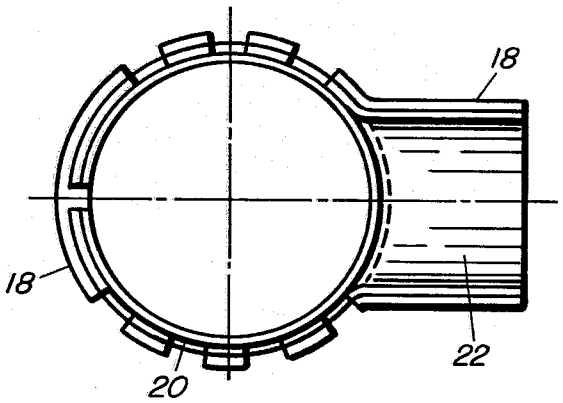
FIG. 2 is a view of the base backshell adapter taken along line 2—2 of FIG. 1.
Figure 1:
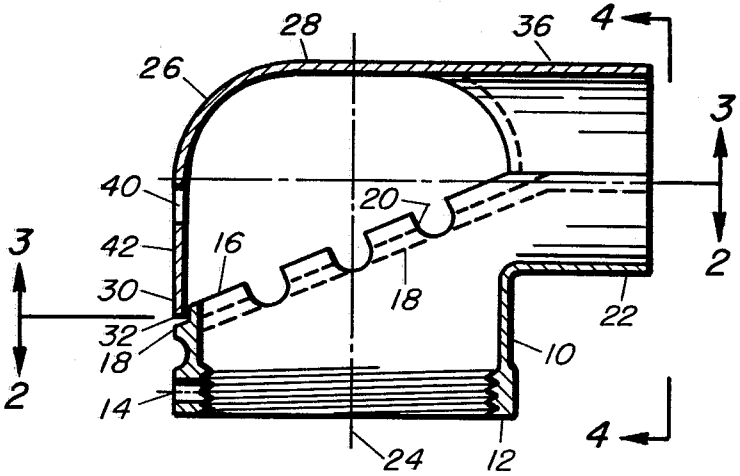
FIG. 1 is a diametral cross-sectional view of the cover and base backshell adapters.

Referring now to FIGS. 1–4 a base backshell adapter member 10, made of such material as cast beryllium copper, tin-plated, as a circularly shaped internally threaded open bottom end 12 having a pin bore 14 transversely positioned therethrough, a top open end 16 having a peripheral intergral flange 18 adjacent thereto and a plurality of radially disposed lead shield solder grooves 20 passing therethrough, and a semicircular tubularly shaped bottom base cable support section 22 extending in a direction normal to the longitudinal axis 24 of the base open bottom end 12. A cover backshell adapter member 26 made of tin plated cast beryllium copper material has a closed cup shaped cover top end 28 and an inclined tubularly shaped cover bottom open end 30 which is slightly larger in diameter than the base member top open end 16. The peripheral edge 32 of the cover bottom end 30 is inclined so that it rests squarely on the base peripheral flange 18. A semicircular tubularly shaped top cover cable support section 34 is integrally connected with the cover top end 28 and extends in a direction normal to the longitudinal axis of the tubular cover open bottom end 30 which is axially aligned with longitudinal axis 24. The inside radius 34 of the semicircular cover cable top support section 36 is slightly larger than outside radius 38 of the base cable bottom support section 22. A transversely positioned potting hole 40 is disposed in the tubular wall section 42 of cover 26.

Figure 5:
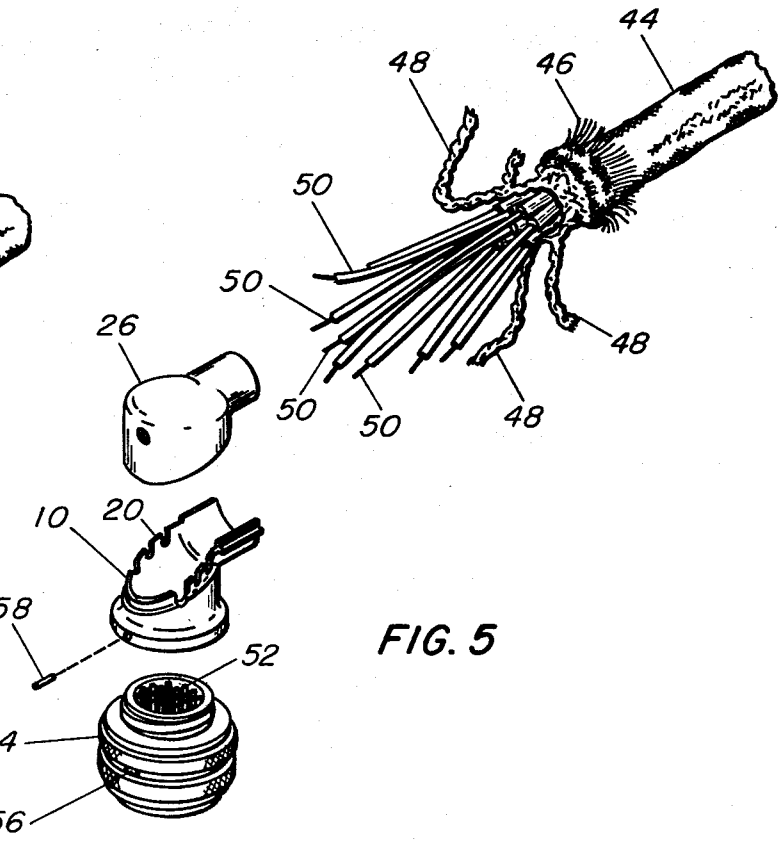
FIG. 5 is an isometric exploded view of the cable assembly.
Figure 6:
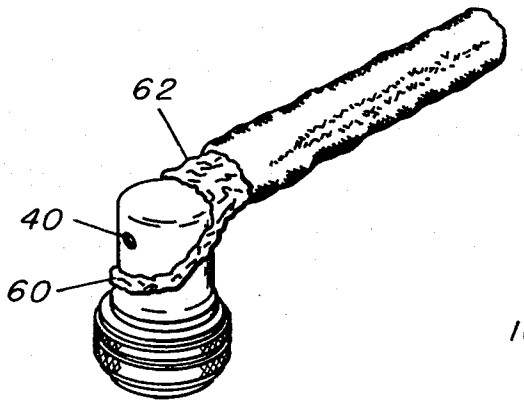
FIG. 6 is an isometric assembled view of the shielded cable assembly.

In operation, referring now to FIGS. 5 and 6, an externally shielded cable 44 if first prepared by stripping back the outer cable braid material 46 and then the internal lead shield material 48 from each twisted pair of electrical conductors 50. The base backshell adapter member 10 is slipped over the cable 44 and the individual leads 50 are then soldered to the connector pins 52 of electrical plug connector 54. The base backshell adapter member 10 is then threaded upon the connector 54 and base pin bore 14 is lined up with a plug pin bore 56 in the plug connector 54. The base adapter member 10 is then fixedly attached to plug 54 by inserting a pin 58 into the base pin bore 14 and the plug pin bore 56 and then soldering the base bottom end 12 to the plug connector 54. The internal lead shields 48 of the twisted lead pairs 50 are passed through the base member lead shield grooves 20 and soldered to the outside of the base adapter member 10. The cover backshell adapter member 26 is then placed over the base adapter member 10 and soldered to it, as shown by soldered joint 60 on FIG. 6, at the intersection of the cover perpherial edge 32 and base peripheral flange 18. The outer shield braid 46 is slipped over the cover top cable support member 36 and the base cable bottom support member 22 and soldered to each as shown by the second solder joint 62 on FIG. 6. A potting compound is then injected through potting hole 40 in the cover adapter member 26 thus completing the assembly.

The foregoing disclosure and drawings are merely illustrative of the principles of the invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. A cable-connector backshell adapter device which comprises:

a base backshell adapter member having a circularly shaped internally threaded open bottom end which has a pin bore transversely positioned therethrough, a base top open end having a peripheral integral flange adjacent to said top open end, said base top open end further including a plurality of radially disposed lead shield solder grooves passing therethrough, and a semicircular tubularly shaped base cable bottom support section extending in a direction normal to a longitudinal axis of said base open bottom end; and cover means operatively disposed on top of said base backshell adapter member, for providing mechanical support for a shielded braided cable assembly and providing a solder area for said shielded braided cable.

2. A cable connector backshell device as recited in claim 1 wherein said cover means comprises:

a cover backshell member having a closed cup shaped top end, an inclined tubular shaped cover bottom open end, said cover bottom open end being slightly larger in diameter than said base top open end, said cover bottom open end being inclined to squarely rest on said peripheral integral flange of said base backshell adapter member when said cover backshell member is operatively disposed on top of said base backshell adapter member, a semicircular tubularly shaped cover cable top support section being integrally connected with said closed cup shaped top end, said cover cable top support section extending in a direction normal to a longitudinal axis of said tubular cover open bottom end, said semicircular cover cable top support section having an inside radius slightly larger than the outside radius of said base cable bottom support section, and a potting hole transversely disposed in a tubular wall section of said cover backshell member.

3. A cable-connector backshell device as recited in claim 2 wherein said base backshell adapter member is made of tin-plated cast beryllium copper material.

4. A cable-connector backshell device as rected in claim 3 wherein said cover backshell member is made of tin-plated cast beryllium copper material.

5. A cable-connector backshell device as recited in claim 4 wherein said cover backshell member and said base backshell member are soldered together at the interface between said cover bottom open end and said peripheral integral flange of said base backshell adapter member.

* * * * *